US006408905B1

(12) United States Patent
Lee

(10) Patent No.: US 6,408,905 B1
(45) Date of Patent: Jun. 25, 2002

(54) ELECTRIC MOTOR-DRIVEN SEMI-AUTOMATIC HANDGUN REQUIRING MICRO-PROCESSOR CODE FOR OPERATION

(76) Inventor: Frederick A. Lee, 682 Broadway, New York, NY (US) 10012

( * ) Notice: Subject to any disclaimer, the term of this patent is extended or adjusted under 35 U.S.C. 154(b) by 0 days.

(21) Appl. No.: 09/733,195

(22) Filed: Dec. 8, 2000

(51) Int. Cl.[7] ..... F41A 17/00
(52) U.S. Cl. ..... 142/70.01; 42/70.11
(58) Field of Search ..... 42/70.01, 70.11; 89/9, 163

(56) References Cited

U.S. PATENT DOCUMENTS

| | | | | |
|---|---|---|---|---|
| 3,991,650 | A | * 11/1976 | Garland et al. | 89/43 R |
| 3,996,687 | A | * 12/1976 | Helbling | 42/84 |
| 4,457,091 | A | 7/1984 | Wallerstein | |
| 4,987,693 | A | 1/1991 | Brooks | |
| 5,022,175 | A | 6/1991 | Oncke | |
| 5,461,812 | A | 10/1995 | Bennett | |
| 5,485,776 | A | 1/1996 | Ealovega | |
| 5,561,935 | A | 10/1996 | McCarthy | |
| 5,860,241 | A | 1/1999 | Waters | |
| 5,915,936 | A | 6/1999 | Brentzel | |
| 5,924,232 | A | 7/1999 | Rhoden | |
| 5,930,930 | A | 8/1999 | Howell | |
| 5,953,844 | A | 9/1999 | Harling | |
| 6,052,934 | A | 4/2000 | Carpenter | |

FOREIGN PATENT DOCUMENTS

JP 04009599 A * 1/1992 ..... 42/84

OTHER PUBLICATIONS

Ron Spomer, Loaded and Locked, Popular Mechanics, Sep. 1998.

Colts Positin on Personalized Weapons Technology—Back to Smart Gun Update, Colts Web Page (www.colt.com), Nov. 10, 1998.

James Gordon Meek, apbnews.com, Jan. 4, 2000.

Colt's "Smart Gun", Shooting Times, Jan. 1997, Published by PJS Publications.

Beretta Announces Position Concerning "Smart Gun" Technology, www.berettausa.com, Jan. 4, 1999.

* cited by examiner

*Primary Examiner*—Charles T. Jordan
*Assistant Examiner*—Gabriel S Sukman
(74) *Attorney, Agent, or Firm*—Bradley N. Ruben P. C.

(57) ABSTRACT

The invention is a handgun in which the spring-loaded slide is replaced by an electric motor, engageable only upon an authorized user entering an access code. A combination rechargeable battery and keypad engages the butt of the handle where the magazine well is located and includes an electrical plug the fits into the handle, making an electrical connection between the battery and a microprocessor in the handgun. Entering the proper code on the keypad allows the microprocessor to complete the circuit between the battery and a motor that actuates the slide. When the device is not in use, the magazine having been removed, the motor then moves the slide rearward, ejecting any cartridge in the chamber, and maintains the slide in a position where the chamber is always open, thereby making obvious to anyone that the gun is not loaded.

14 Claims, 6 Drawing Sheets

ELECTRIC MOTOR-DRIVEN SEMI-AUTOMATIC HANDGUN REQUIRING MICRO-PROCESSOR CODE FOR OPERATION

FIELD OF INVENTION

This invention relates to semi-automatic handguns, and addresses the national quest to create greater safety in their use, operation, and storage. More particularly, this invention replaces the slide spring with electrical motor-driven gears, and requires the user to enter a numerical code to activate the motor, thus relating to both the slide mechanism and to a coded means for securing the handgun.

STATUS OF PRIOR ART

The national publicity surrounding the Second Amendment of the Bill of Rights and the use of handguns by unauthorized individuals has heightened public concern about firearm safety. It has also raised serious questions about gun ownership; in particular the right of individuals to possess high-capacity semi-automatic handguns. The present design of these handguns renders them inherently unsafe; they do not restrict who it can be used by, and the unloaded condition cannot be visually verified. Attempts to make the century-old semi-automatic handgun technology safer in an age of consumer protection has been limited to non-indigenous safety locks or computerized hand recognition devices that are operationally impractical.

All semi-automatic handguns work by using a mechanical spring action designed to slide a cartridge from the top of the magazine, pushing it forward and inserting it into a firing chamber comprised of the gun barrel; the open breech is sealed by the back of the slide. After firing, the cartridge shell casing is extracted rearward, by the combination of particular machining of the slide and the force of the explosion, within a fraction of a second. The slide in the full rear position cocks the spring-actuated hammer back for refiring. After this cycle of cocking is completed, the shell is ejected, and the compressed spring returns the slide forward stripping off the next cartridge for loading in the chamber. The hammer remains cocked ready for striking the firing pin when the trigger is pulled.

The cartridge magazine, which is inserted in the base of the hand-grip of the gun, is pre-loaded with cartridges for firing. It employs a spring at the cartridge magazine base to force each of the stacked cartridges upward to align in a manner that allows them to be inserted into the barrel by the forward action of the slide. When the last cartridge is fired, the spring-loaded base platform in the cartridge magazine, above which the cartridges were seated, creates a mechanically locked condition whereby the slide remains open indicating that the weapon is unloaded. After removal of the empty cartridge magazine and the insertion of a new loaded magazine, the slide, in tension by the compressed spring in the handgun is driven forward forcing a cartridge into the barrel.

All semi-automatic handguns require the squeezing of the trigger each time to fire. Industry standard provides a manual safety that locks the slide and/or the trigger. This safety is located near the trigger and can be operated by the thumb. Standard on models with exposed hammers is the ability of the user to slowly de-cock the hammer over a chambered cartridge without firing. This safety feature is of questionable value as a dropped handgun in this condition can fire.

Inherent to all semi-automatic handguns is their inability to prevent unauthorized individuals from using them without a non-indigenous locking safety device as illustrated by the Carpenter patent 6,052,934 and the McCarthy patent 5,561,935; or are of such complexity as per the Brooks patent 4,987,693 or require the complicity of a delicate electronic technology as represented by the Brentzel patent 5,915,936 and the Harling patent 5,953,844 as to make them either impractical for industry application or represent a state of art not achievable by present art.

Even with such locking devices, the loaded/unloaded condition of the handgun is not addressed. Although unauthorized use of the handgun may be prevented in theory by those inventions, the question of a single cartridge remaining in the closed slide with the cartridge magazine ejected is not addressed. Only if the slide has been locked in the open position as indicated by the external locking device of the Carpenter patent, can a visual confirmation be made that the handgun is in the inoperable, full-safe condition. As present art relies so heavily on the handgun main spring, located below the barrel to operate the slide, storage of the gun with the slide in the full open position creates a reliability problem by weakening the spring over time, and so the gun is stored with the slide closed. As such, a person looking at the gun cannot determine whether or not the gun is loaded because the slide is closed.

SUMMARY OF INVENTION

In view of the foregoing, the main object of this invention is to create an semi-automatic handgun that provides a visible safety confirmation and restricts the use of the handgun to authorized individuals through an integrated operating system that must be satisfied before the handgun can be fired. The incorporation of three diverse arts: the individually hand-held, rechargeable battery powered, electric-motor driven tool; a micro-processor that functions as an on-off switch linked to a digital code pad; and cyclical action of the semi-automatic handgun as per the existing art.

A battery powered electric motor, through gears located on both sides of the barrel, drives the slide forward and backward. This motor-gear combination is placed where the main handgun spring is located, replacing the function of the spring in the operating cycle. A rechargeable battery, similar to those used in hand held power tools provides the electrical source. The battery, attached to the base of the magazine, connects via wires in the hand-grip when the cartridge magazine is inserted for loading. This contact makes a circuit with the electric motor.

A micro-processor embedded within the handgun frame in front of the trigger guard functions as an electric switch for engaging the motor-battery circuit. This micro-processor switch has a memory code which is known only to the owner and the handgun manufacturer. It can be only referenced through the handgun serial number and to the authorized owner/user. Without the correct numerical digital code pressed in to the keypad located and integral with the battery power supply, a completed electrical circuit for operating the slide cannot be made, and then the handgun remains in the full safe open position. As the micro-processor switch is manufactured as internal to the handgun frame, only a is highly skilled gunsmith can effectuate its removal and replacement. This limits the use of the handgun if it is stolen or illegally purchased.

After the correct numerical code is entered into the micro-processor via the keypad, the circuit between the battery and the electric motor is completed. The gears, driven forward by the motor, close the slide over the barrel thereby chambering the first cartridge on the top of the magazine. The trigger mechanism, firing-pin, hammer cock action, and slide-breech closure are existing state of the art, as is the mechanical sear that controls semi-automatic firing; one trigger pull for a single firing. Expended shell extraction and ejection is also current art. However, the recoil spring action is handled by the reaction of the electric motor through the gears on the slide. A fine tuning of reaction forces; the electric motor-gear connection/control of the backward motion of the slide, requires a passive-aggressive action by the assembly; the motor and gears first slowing the recoil, then strongly moving the slide forward. In cases where firing has not been successful and the slide is not driven rearward by reactive forces because the chambered cartridge is defective, the internal hammer is recocked by allowing the user to re-enter the code via the keypad. This causes a pre-programed action that moves the slide back only partially, causing the hammer to be recocked. The user can pull the trigger to strike the firing pin again on the seated cartridge. When the handgun user is satisfied that firing the chambered cartridge is not possible, the slide action is moved rearward by pressing the cartridge magazine ejection button. In addition to mechanically decoupling the cartridge magazine from the hand-grip, it creates an electrical circuit that signals the motor to automatically move the slide rearward and eject the un-fired cartridge.

Upon completion of the rearward cycle of the slide action, the cartridge/shell is ejected and the hammer is re-cocked. The electric motor, through an internal switch as per existing power tool art, then reverses the direction of the slide through motor-gear action to move it forward. The motor/gear action replaces the current handgun spring, returning the slide forward. A cartridge is stripped off the top of the cartridge magazine and chambered as per existing semi-automatic handgun art. The handgun is ready to be fired; the cycle of firing, ejection, cocking and re-chambering has been completed. A manual safety lock for the trigger can be engaged for the chambered cartridge as per existing art is retained.

There are two significant advantages to this invention which are unlike any current handgun safety and user restriction:

By using an electric motor/gear action to replace the main spring action of existing art to operate the slide action that chambers and ejects the cartridge, the motor requires an electric power source to work. A switch in the form of a micro-processor allows the completion of a circuit for the electric motor/gear action to operate the slide chamber a cartridge. For this to occur, the micro-processor switch requires a code to be entered via a keypad before it will allow a circuit to be made between the battery power source and the motor. The code is preferably numeric, but can be alpha, or alphanumeric, or even symbolic (depending on the keypad chosen). The requirement of knowledge the code limits the use of the handgun. Any unauthorized individual such as a child who wants to play with it and inserts a loaded cartridge magazine correctly, cannot, without knowledge of the correct code, complete the electrical circuit whereby the slide moves forward to chamber a cartridge.

Whereas the above restricts its use to those authorized, the second safety aspect of the invention answers the question of the authorized handgun user as to the state of the chambered condition. Current art allows the semi-automatic handgun to have a chambered cartridge even when the cartridge magazine is ejected. The only way it can be ascertained with certainty and by visual means that the handgun is not loaded is when the slide is locked in an opened, rearward position. As this condition puts undue stress on the state of art main gun spring, storage in this condition is impractical for present day handguns. The present invention, through the use of an electric motor/gear driven slide, creates a visually obvious, unambivalent condition: if the hand gun is unloaded and therefore fully safe, the slide is in the full-open position; if the slide is forward and closed, an appearance similar to existing semi-automatic handguns (that may or may not have a chambered cartridge), it is loaded and can be fired.

BRIEF DESCRIPTION OF DRAWINGS

For a better understanding of the invention as well as other objects and further features thereof, reference is made to the following detailed description to be read in conjunction with the accompanying drawings. Wherein.

DESCRIPTION OF INVENTION

Figure 1:
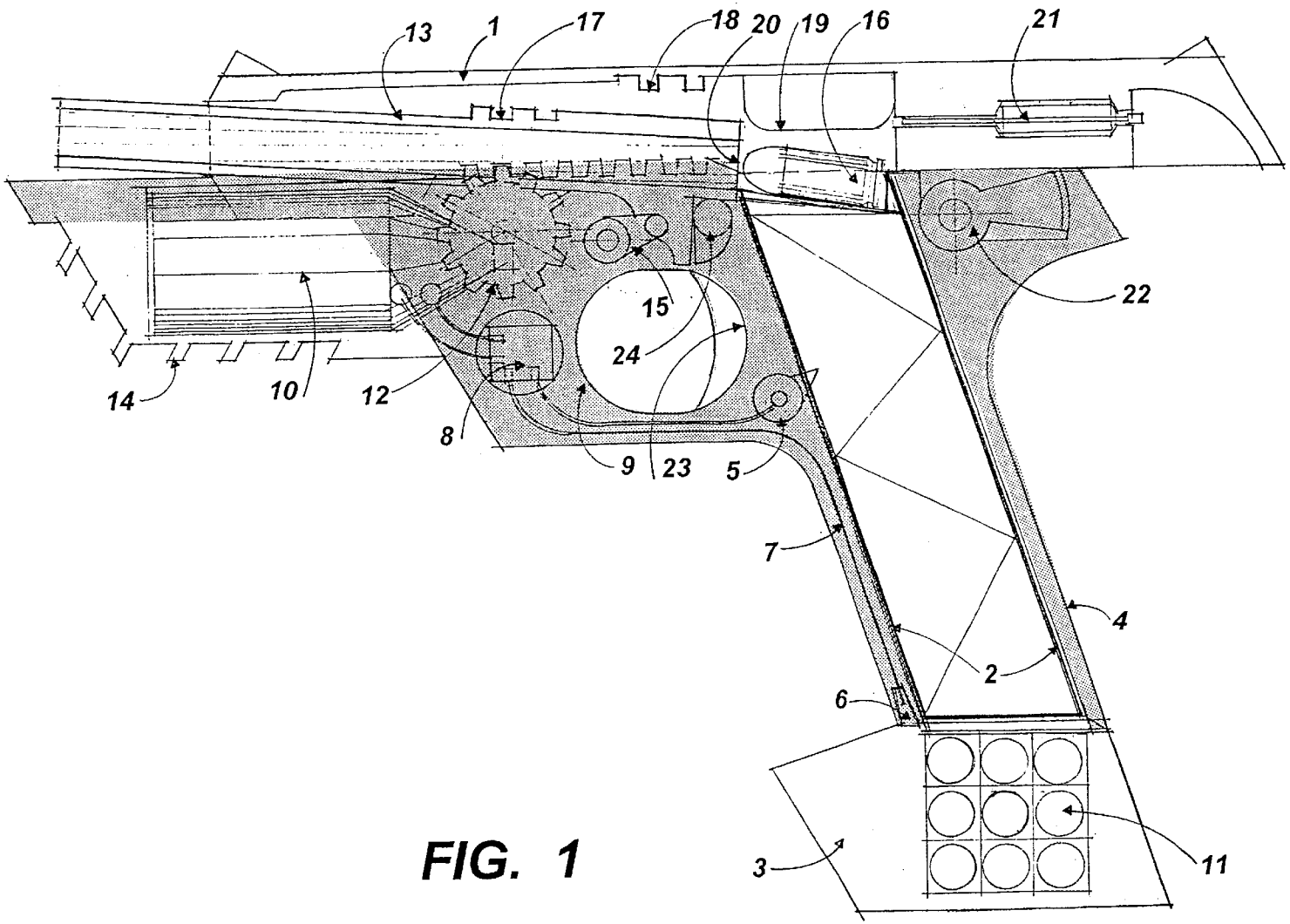
FIG. 1 depicts an idealized cut away or cross sectional view of the handgun in the slide open condition with a cartridge magazine, having a rechargeable battery, inserted into the handle.

Referring now to FIG. 1, shown therein is a cross section of the semi-automatic handgun with the slide (1) in the open condition and with the cartridge magazine (2) and a rechargeable electric battery (3), attached to the bottom of the magazine, inserted into the bottom of the hand grip (4) and locked into place by a button-activated spring catch (5), as cartridges are presently retained per existing art. The cartridge magazine having been inserted and locked into place makes an electrical connection with the rechargeable battery through an articulated plug (6) in the base of the hand-grip, connected to internal wires (7) within the handgun frame (gray tone), passing through the micro-processor (8) and ending at the motor (10).

The electrical wires from the battery are connected to a micro-processor (8) which is embedded in the gun-frame and located in front of the trigger guard (9). So located, the micro-processor requires special tools for its removal and replacement. The micro-processor functions as an electrical switch. It creates a complete circuit that allows the electric motor (10) to operate only when the micro-processor switch receives the correct, preset numerical code from the handgun user via a keypad (11), preferably digital, integral to the rechargeable battery on the left hand side at the base of the handgrip.

Upon receiving the correct code entered by the handgun user, thereby completing the circuit by causing the microprocessor to switch correctly, the electric motor will close the open slide by means of two mechanical gears (12) located on each side of the gun barrel (13). The electric motor replaces the present art main gun spring for slide operation and is located in the same position, below the front end of the gun barrel. It is attached to the cantilevered extension of the gun frame and is surrounded by a removable, housing (14) that is finned for heat dissipation.

Note that the downward alignment of the barrel prior to loading is dictated by the position of a mechanical cam (15) that will rotate the barrel upward as the slide drives the cartridge (16) forward loading the handgun and that grooves or notches on the top of the barrel (17) will match the grooves or keys on the slide (18) to create a locked condition when the slide is forward. The mechanics of this cycle are as per state of the art for heavier caliber handgun cartridges. Note that for smaller caliber cartridges, a direct slide back and forward motion is sufficient as per prior art. The location and function of the cartridge side ejection port (19), the slide function for breech closure and cartridge extraction (20), the internal, spring returned firing pin (21), the automatic self-cocking firing pin hammer (22), and the trigger mechanism (23) and trigger-locking safety (24), common for both small and large caliber semi-automatic handguns, are all well-known in the art.

Figure 2:
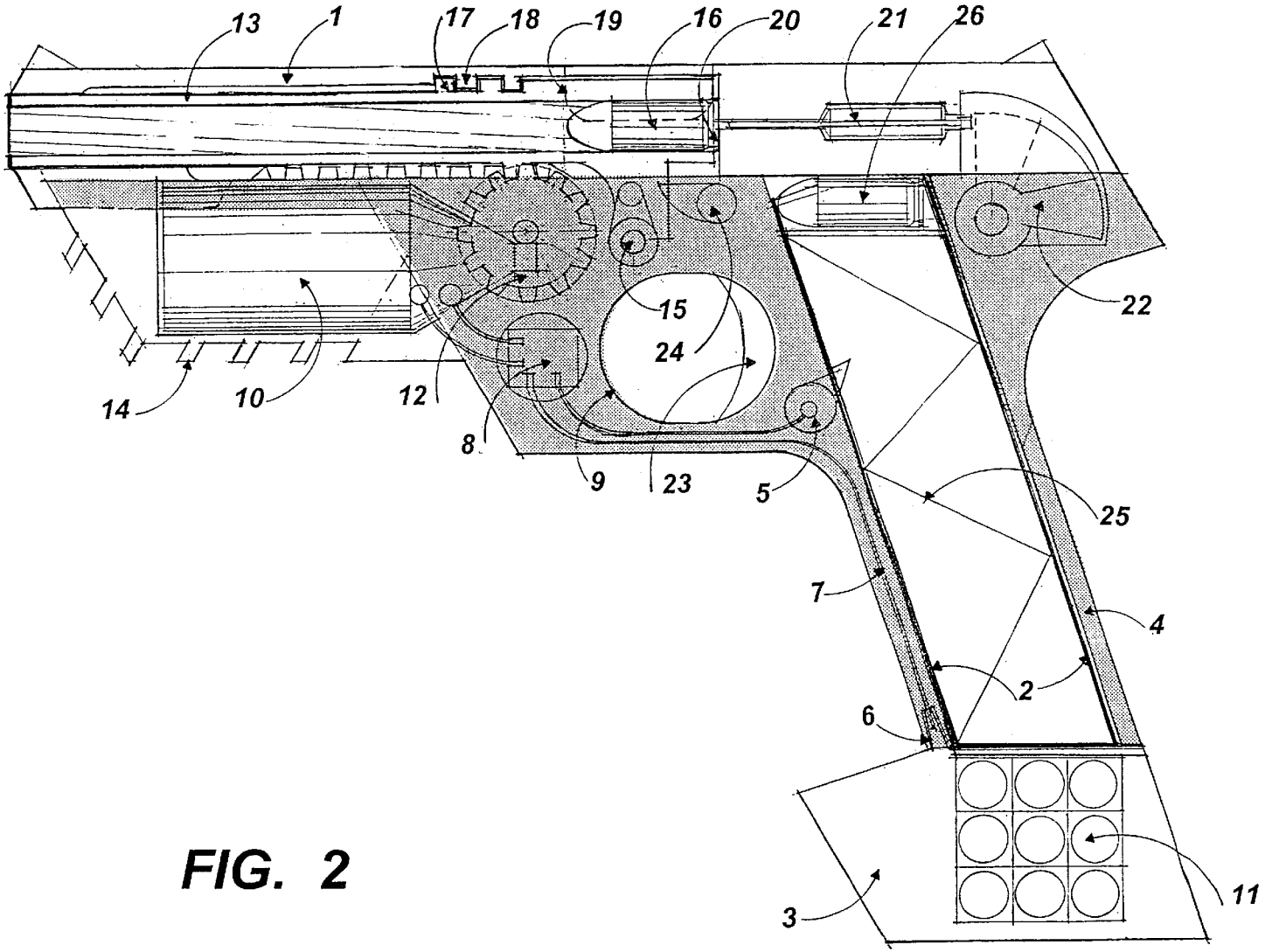
FIG. 2 depicts the same idealized cut away or cross sectional view as in FIG. 1 but illustrates the handgun in the slide-closed position ready to be fired.

FIG. 2 illustrates the same cross section of the hand gun with the slide closed in the ready to fire condition. The slide (1) has been driven forward by the action of the powered electric motor via gears. A cartridge (16) has been stripped-off the top of the cartridge magazine and chambered into the gun barrel (13), the breech (20) being closed by the forward movement of the slide.

The spring action (25) within the inserted cartridge magazine which feeds the stacked cartridges upward, has at its top another cartridge (26) ready for chambering. This is unchanged as per existing art; as is the forward/rearward action of the slide to load and extract cartridges. A spring actuated, internal firing pin hammer (22), also as per existing art, is used in place of the more conventional manually cockable hammer, is not germane to the safe operation of the present handgun. However, recognizing the condition that requires the recocking of the hammer on a chambered cartridge that has not been successfully fired, to allow a second or third try before extraction and ejection is attempted, the following resetting process is performed: re-entering the accepted user's code on the key pad commands the slide to move rearwardly sufficiently to recock the firing pin hammer but not far enough to extract the cartridge.

If the cartridge still has not been fired after the resetting process, or the user wishes to change the inserted, cartridge filled magazine, pressing the cartridge magazine ejection button/spring lock (5) as per existing art, creates an electrical connection that, in addition to ejecting the magazine, signals the motor to move the slide (1) to the open position, thereby automatically extracting and ejecting the cartridge if one remains chambered. As the slide is returned to the fully open position, the cartridge magazine and rechargeable battery combination then can be removed, the handgun is visibly inoperable, the motor is without power, a safety of the invention.

Figure 3:
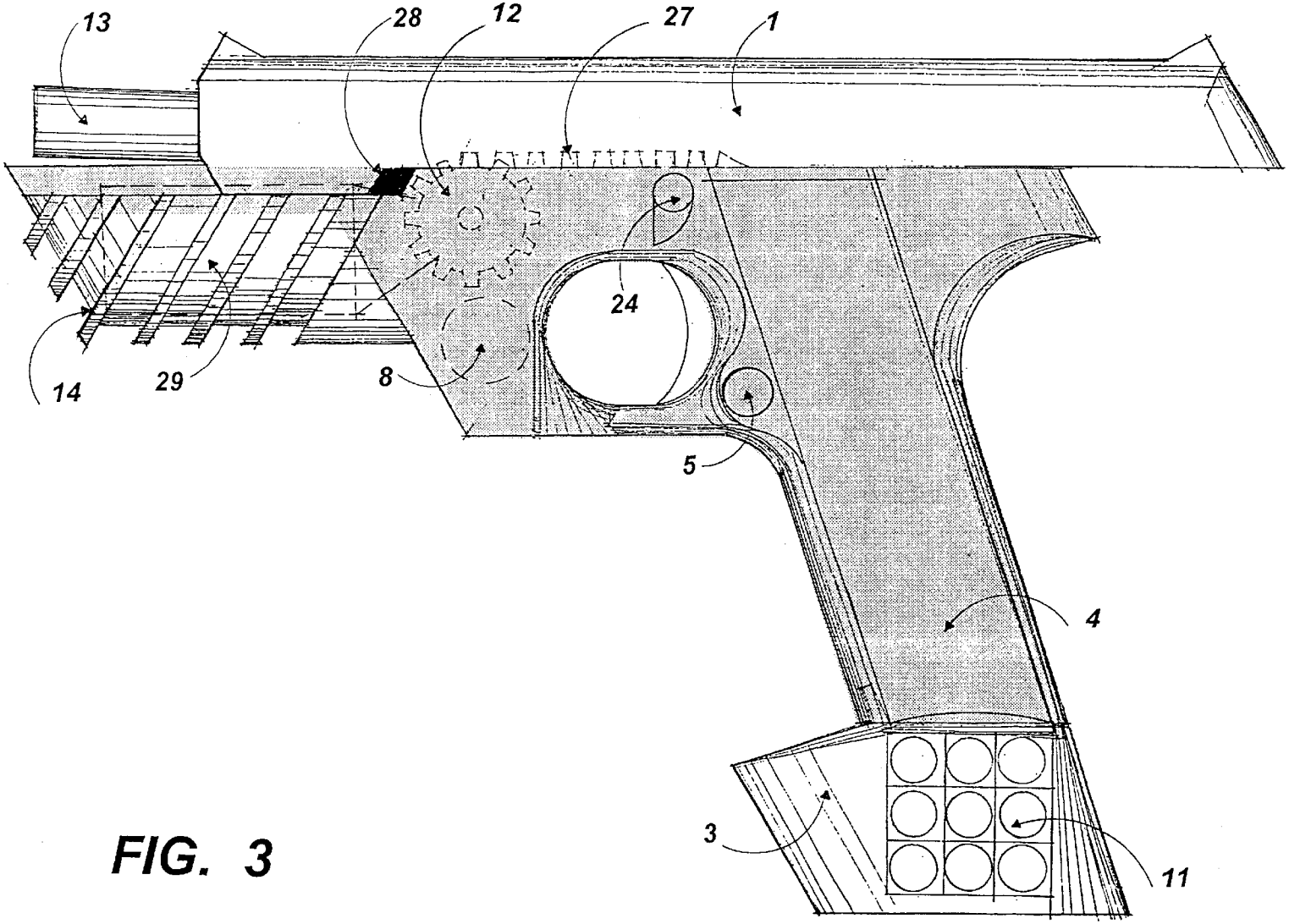
FIG. 3 presents an exterior left-side view of the handgun with the slide in the open position having a cartridge magazine and rechargeable battery combination inserted into the handgrip, the correct code waiting to be entered prior to the closing of the slide.

FIG. 3 presents the exterior left-hand side view of the handgun, the slide in the open position with an inserted cartridge magazine and rechargeable battery. The illustration shows the relationship of the numerical key pad, an element integral to the rechargeable battery and its preferred location at the bottom of and on the left hand side of the hand grip. Upon the entry of the correct code recognized by the micro-processor switch (8), a complete circuit is made between the electric motor (10) and the battery (3) via internal wiring in the handgun frame. This allows the slide (1) to be driven forward mechanically, chambering a cartridge from the magazine, through the action of the electric motor driven gears against the matching teeth (27) machined within the slide casing. The gears and matching teeth are internal to the gun frame (dashed outline) and slide so as to present no danger of hand injury or jamming due as created by an exposed condition. Preferably, paired, matching, rubber impact bushings (28) on both sides of the slide (1) and gun frame (gray tone) are provided at the final rearward movement position where the slide impacts the handgun frame to allow some residual cushioning between the slide and the frame in the firing—extraction—ejection sequence of the handgun operation. The electric motor housing (29) preferably has a series of fins that provide for heat dissipation and creates a visual identity for this particular handgun design. Of course, that section can be adapted to accept a flashlight, laser pointer, or similar device to be attached to the handgun. The cartridge magazine ejection button (5) and mechanical trigger safety lock (24) are located as per state of art for semi-automatic handguns.

Figure 4:
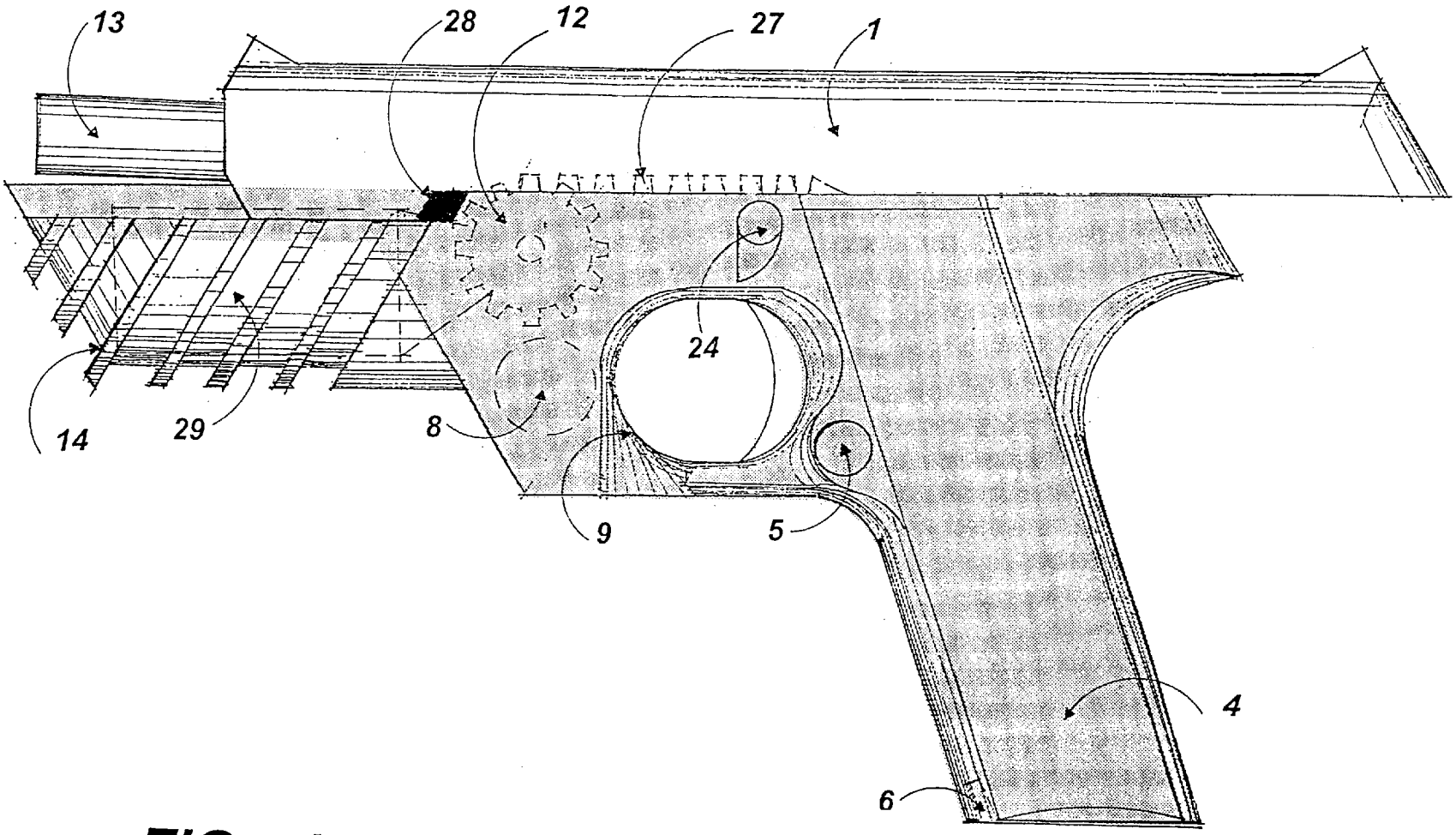
FIG. 4 presents the same left side exterior view in the slide open position as in FIG. 3, but depicts a full safe condition with the cartridge magazine rechargeable battery combination removed.

FIG. 4 illustrates the left side elevation of handgun with the slide open. The battery and cartridge magazine combination is removed, the handgun is visually observable as being unloaded and incapable of firing. In this condition it can be safely stored without resorting to any special locked cabinet or enclosure as mandated by handguns presently in the art.

Figure 5:
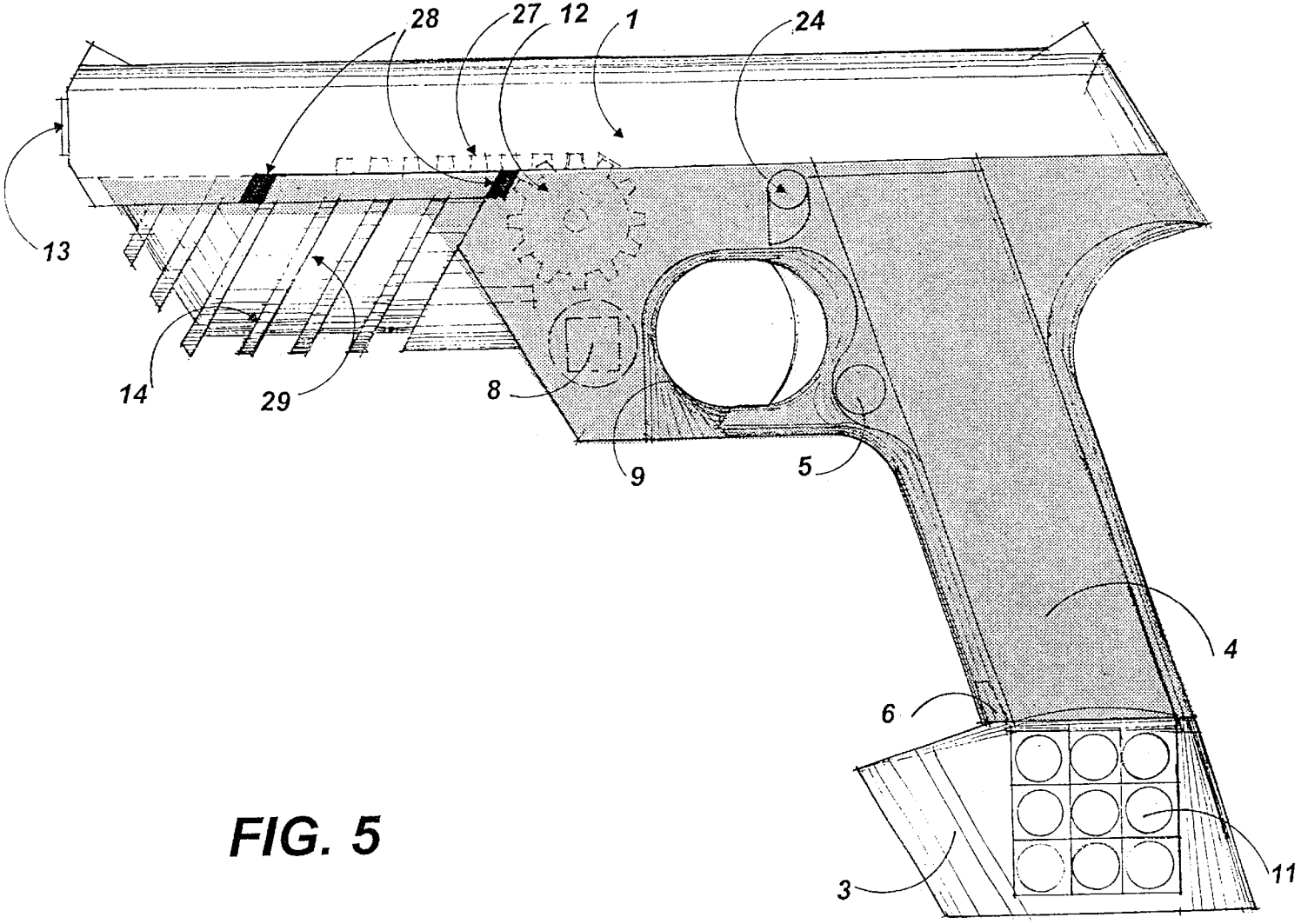
FIG. 5 is the same left hand view as shown in FIGS. 3 and 4, the cartridge magazine rechargeable battery combination inserted, the slide now closed after the correct code has been submitted, in the ready to fire position.

FIG. 5 presents the left-hand elevation of the handgun with the slide closed in the ready to fire position. A cartridge magazine has been inserted, the rechargeable battery (3), and nine digit keypad (11) are visible. The weight of the battery at the bottom of the hand-grip (4) offsets the front heaviness of the handgun created by the electric motor which replaces the slide return spring located below the front of the gun barrel. With the cartridge magazine and battery inserted, the overall appearance of the design is similar to existing hand held, battery driven power tools.

Figure 6:
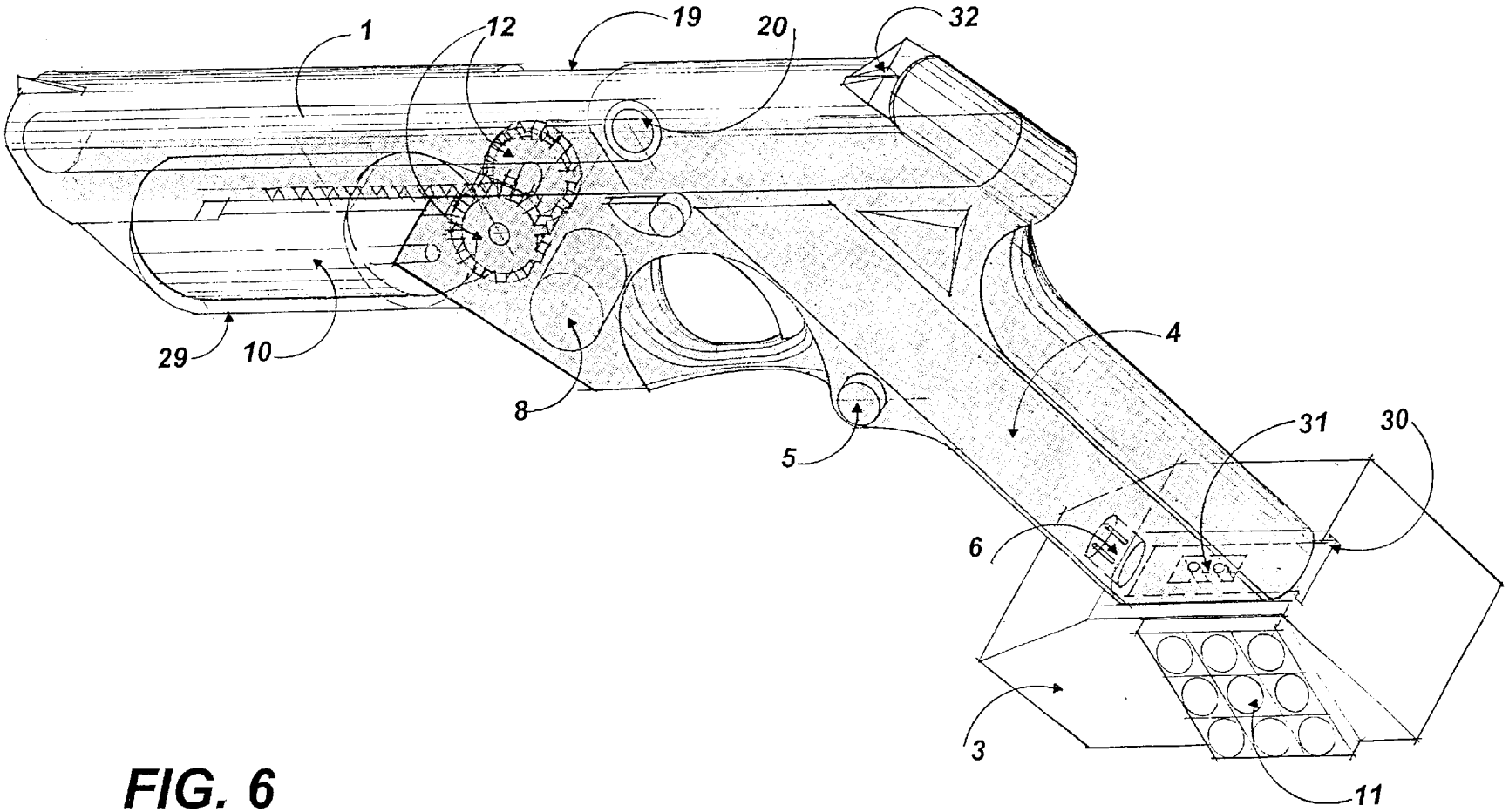
FIG. 6 is a semi-transparent perspective view illustrating the handgun with the slide-closed and ready to fire.

FIG. 6 is a downward looking semi-transparent, perspective view that shows the handgun in the slide closed, ready to fire condition, as identical to the FIG. 5 condition. The rechargeable battery (3) with numerical key-pad (11) on the left side below the hand-grip (4) details the attachment of the battery by means of a grooved-channel (30), although a secure, releasable snap-fit attachment is also suitable. The channel which locks the bottom of the cartridge magazine to the top of the battery, mandates the removal of the cartridge magazine from the battery to gain access to the recessed battery recharging plug (31). This preferred safety feature insures that the battery cannot be recharged while cartridges are loaded in the magazine.

As illustrated, the battery (3), keypad (11), and cartridge magazine(2) combination is inserted into the hand-grip and locked into place by the spring action of the cartridge magazine ejection button catch (5). Thus seated, an electrical connection is been made between the power-plug (6) on the top-front of the battery (3) and the wires in the hand-grip. This connection travels via wires (7) in the handgun-frame (gray tone) to an embedded micro-processor switch (8) located in front of the trigger guard (9). The slide closed condition indicates that the correct code has been entered on the key pad (11) by the user, the motor (10) has driven the slide (1) forward via the paired gears (12) over the top of the cartridge magazine thereby stripping off a cartridge and loading it into the aligned barrel (13). The trigger lock safety (24) and grove/rear-blade/front gun sight (32) represent existing art.

It should be understood that embodiments are envisioned wherein the slide spring is still present to absorb the force of the slide's recoil, and while the spring will thus urge the slide forward, the forward motion of the slide is controlled by the motor. In such an embodiment, the spring can be anchored to a cam, and when the handgun is de-activated by the motor moving and locking the slide open, the cam can be moved, decreasing if not eliminating the force on the spring while the gun is in the de-activated and safe position.

While there has been shown a preferred embodiment of the invention, it is to be understood that many changes may be made thereon within the spirit of the invention.

I claim:

1. A safer system for a semi-automatic handgun that denies permission for its use except for the authorized owner/user, and visually conveys, by means of its physical condition, whether it could be fired, said system comprising:

A. a cartridge magazine-fed, slide operated, semi-automatic handgun with a forward loading and rearward ejection cycle;

B. a rechargeable battery connected to an electric motor disposed in the handgun that drives the slide forwards and backwards effective to load and eject a cartridge; and C. a micro-processor switch with a pre-set code recognition feature that upon receiving the correct code entered by the authorized user of the handgun enables the motor to close the slide to load the handgun, and commands that when the cartridge magazine ejection button is pressed the motor engages to open the slide to eject any chambered cartridge.

2. A system as set forth in claim 1, wherein the cartridge magazine releasably engages a rechargeable electric battery, said cartridge being locked in place in the gun by a spring catch and forming an electrical connection via a plug between the battery and the micro-processor via wires embedded in the handgun.

3. A system as set forth in claim 2, wherein the rechargeable battery includes a keypad for entry of said code, and wherein the electrical connection between the battery and the motor is completed only upon entry of said code.

4. A system as set forth in claim 1, in which after firing, the cartridge in the barrel is extracted and ejected by a combination of the physical force of the recoil and the controlling action of the gears and the slide with electric motor, the final rearward limit of the slide travel accommodated by rubber contact points between the slide and the gun frame.

5. A system as set forth in claim 1, in which the electric motor reverses direction of the slide at the rear of its travel, moving the slide forward to strip-off another cartridge from the top of the magazine, loading the cartridge into the barrel, and closing the breech.

6. A system as set forth in claim 1, in which when the last cartridge in the magazine has been fired, the cartridge magazine spring engages the slide through a mechanical sear which prevents the slide from closing, thereby signaling the micro-processor switch to stop the electric motor from closing the slide and commands the motor to return the slide to the full open position.

7. A system as set forth in claim 1, in which the cartridge magazine is ejected by pressing an ejection button on the hand-grip, and pressing said ejection button causes the microprocessor to command the slide to return to the full open position.

8. A system as set forth in claim 7, wherein pressing said ejection button causes the cartridge magazine to be ejected, the micro-processor thereafter retaining a confirmation of the correct code for a predetermined period of time to allow the user to insert a fresh cartridge magazine and for the handgun to operate, without having to reinsert the correct code on the keypad when the fresh cartridge magazine is inserted.

9. A system as set forth in claim 1, wherein if after a predetermined period of time a fresh cartridge magazine has not been inserted, then the microprocessor commands the motor to move the slide to the open position and then to sever the electrical connection, resulting in the handgun slide remaining locked open by the unpowered electric motor, and the now fixed condition between gears and the teeth within the slide, thereby indicating a full safe condition for the handgun.

10. An improved semiautomatic handgun having a slide, wherein the improvement comprises an electric motor disposed in the handgun for moving the slide forward, a battery for powering the electric motor, a microprocessor-based switch disposed in the handgun for controlling the electrical circuit between the battery and the motor, and a keypad for communicating with the microprocessor.

11. The improved handgun of claim 10, wherein the spring normally urging the slide forward is eliminated.

12. The improved handgun of claim 10, wherein the battery is rechargeable.

13. The improved handgun of claim 12, wherein the battery and the keypad are an integral unit that can be releasably attached to the handgun.

14. The improved handgun of claim 12, wherein the battery can be releasably attached to the handgun and the keypad is disposed on the battery.

* * * * *